US007901232B2

(12) United States Patent
Kodaira

(10) Patent No.: US 7,901,232 B2
(45) Date of Patent: Mar. 8, 2011

(54) ELECTRICAL CONNECTOR FOR A FLEXIBLE FLAT CABLE

(75) Inventor: Yoshihiko Kodaira, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 12/633,542

(22) Filed: Dec. 8, 2009

(65) Prior Publication Data

US 2010/0081312 A1 Apr. 1, 2010

Related U.S. Application Data

(63) Continuation of application No. PCT/JP2008/060450, filed on Jun. 6, 2008.

(30) Foreign Application Priority Data

Jun. 8, 2007 (JP) ..... 2007/153299

(51) Int. Cl.
*H01R 13/15* (2006.01)
*H01R 13/62* (2006.01)

(52) U.S. Cl. ..... 439/260; 439/329; 439/495

(58) Field of Classification Search ..... 439/260, 439/261, 329, 492–495
See application file for complete search history.

(56) References Cited

U.S. PATENT DOCUMENTS 4,778,403 A * 10/1988 Ikesugi et al. ..... 439/329
7,172,446 B1 2/2007 Hashimoto et al.
2009/0298319 A1 12/2009 Takahashi et al.
2010/0087078 A1 4/2010 Hemmi et al.

FOREIGN PATENT DOCUMENTS

JP 2007059217 A 3/2007
JP 2007265851 A 10/2007
JP 2007287398 A 11/2007
JP 2008108458 A 5/2008

OTHER PUBLICATIONS

IPRP issued in co-pending International Application No. PCT/JP2008/060450, dated Dec. 11, 2009, 6 pages.

* cited by examiner

*Primary Examiner* — Javaid Nasri
(74) *Attorney, Agent, or Firm* — Barley Snyder LLC

(57) ABSTRACT

An electrical connector is provided, capable of exerting a sufficient clamping force on a flat cable to reliably provide electrical conductivity while the connector is low-profile. The connector includes a contact having a base, a contact beam, and a pressing arm. The pressing force of a cam of an actuator is transmitted to a base through the pressing arm. Thereby, lift of the base is restrained, and a flat cable is reliably clamped, thereby providing electrical conductivity. Also, elastic deformation of the pressing arm reduces the range of variations in the contact pressure of a contact arm of the contact beam caused by the variations in thickness, gap, dimension, and the like.

11 Claims, 5 Drawing Sheets

Prior Art

ELECTRICAL CONNECTOR FOR A FLEXIBLE FLAT CABLE

CROSS-REFERENCE TO RELATED APPLICATIONS

This application is a continuation of PCT International Application No. PCT/JP2008/060450, filed Jun. 6, 2008, which claims priority under 35 U.S.C. §119 to Japanese Patent Application No. JP 2007-153299, filed Jun. 8, 2007.

FIELD OF INVENTION

The invention relates to an electrical connector, in particular, to an electrical connector to which a flexible flat cable is connected.

BACKGROUND

An electrical connector (hereinafter referred simply to as a connector) for a flexible flat cable such as a flexible printed circuit (FPC) or a flexible flat cable (FFC) is mounted on a printed wiring board. In a housing of the connector, a plurality of contacts that are electrically connected to the printed wiring board are provided. By electrically connecting these contacts to the conductors of the flat cable, the flat cable is connected to the printed wiring board.

In the connector, in order to keep an electrically connected state between the flat cable conductors and the contacts, typically, the flat cable is clamped by the contacts, and each of the contacts is made in a state of being pressed against the flat cable conductor by utilizing the elasticity of the contact itself. When the flat cable is inserted into the connector, the insertion of the flat cable should be prevented from being hindered by the resistance of contacts. For this purpose, a ZIF (Zero Insertion Force) type connector that keeps the contacts in an opened state is available.

In such a ZIF type connector, the contact having been in an opened state is deformed and operated by an actuator, whereby the contact is pressed against the flat cable conductor. A known ZIF type connector, for example, is disclosed in Japanese Patent Laid-Open No. 2002-270290. As shown in FIG. 5, a known contact 1 is a flat and having a substantially H-shape. The contact 1 includes contact arms 2 and 3, a pivot 4, a lever 5, and a base 6. When an actuator 7 is turned clockwise, the lever 5 is displaced upward by a cam 8, and the pivot 4 of the contact 1 is elastically deformed. Thereby, a flat cable 9 is clamped between the contact arms 2 and 3, and is electrically connected to the contact 1.

However, conventional contacts, as described above, have certain problems.

In the contact 1, the contact arm 2 and the lever 5 form one beam, and the contact arm 3 and the lever 6 also form one beam. Therefore, in order to reliably clamp the flat cable 9 between the contact arms 2 and 3, the displacement of the lever 5 caused by the elastic deformation of the pivot 4, produced by the operation of the actuator 7, must be transmitted efficiently to the contact arm 2. However, when the lever 5 is displaced upward by the operation of the actuator 7, the displacement of the contact arm 2 is restricted by the contact of the contact arm 2 with the flat cable 9. Thereby, the contact arm 2 is subjected to a reaction force from the flat cable 9, so that the lower portion of the pivot 4 is raised, and lifts from a printed wiring board 100. Therefore, the displacement of the contact arm 2 becomes smaller than the displacement inherently produced in the contact arm 2 by the operation of the actuator 7, along with the elastic deformation produced in the contact arm 2 and the lever 5. As a result, depending on the thickness of the flat cable 9, the force for pressing the contact arm 2 against the flat cable 9 (referred to as a contact pressure) may be insufficient To solve this problem, it is thought that the distance from the pivot 4 to the point of application of the force in the actuator 7 is increased by lengthening the lever 5 to increase the clamping force for the flat cable 9 between the contact arms 2 and 3, or the rigidity of the lever 5 is enhanced. However, in such a design, the size of the contact 1 is increased, or the length in the front-back direction thereof is increased. As the sizes of various pieces of electrical and electronic equipment decrease, the connector especially requiring a large mounting area on the printed wiring board 100 is also required to be made small in size. The increased size and rigidity of the contact 1 are unfavorable because they hinder the decrease in size of connector. Also, in the case where the rigidity of the lever 5 is enhanced, the force required for the operation of the actuator 7 increases, so that the operability of the actuator 7 may be degraded.

The connector is required to be formed so that the height, thereof in the state of being mounted on the printed wiring board 100, is decreased as far as possible (this is called low-profile). The conventional flat and substantially H-shaped contacts are also formed so as to meet this requirement. However, if the lever 5 is lengthened, the displacement on the rear end side of the lever 5 at the time when the lever 5 is operated by the actuator 7 increases, which hinders the contact from being low-profile.

Also, the contact 1, the cam 8 of the actuator 7, and the flat cable 9 vary in dimensions. By the variations in the gap between the lever 5 and the base 6 of the contact 1, and the variations in dimension in the major axis direction of the cam 8, the upward displacement of the lever 5 at the time when the actuator 7 is operated varies. Also, by the variations in the gap between the contact arms 2 and 3 of the contact 1, the displacement of the contact arm 2 caused by the displacement of the lever 5 varies. Further, the variations in thickness of the flat cable 9 also lead to the variations in the relative displacement of the contact arm 2 with respect to the flat cable 9. The variations in these dimensions are amplified according to the lengths (lever ratio) of the contact arms 2 and 3 and the lever 5. As a result, the variations in these dimensions lead to the variations in contact pressure of the contact arm 2 against the flat cable 9 for each contact 1 or each connector. If the contact pressure is insufficient, the flat cable 9 may not be clamped reliably by the contact 1. Also, if the contact pressure is excessive, the surface of the contact point of the contact 1 may roughen and electrical conductivity may become impaired. In the case where the contact pressure is excessive, the contact arm 2 and the lever 5 may be deformed plastically, exceeding the elastic deformation zone. In this case, when the flat cable 9, having been clamed by the contact 1, is unclamped by the operation of the actuator 7, for example, at the time of maintenance, the gap between the contact arms 2 and 3 does not widen sufficiently. As a result, even if an attempt is made to insert the flat cable 9 again, the flat cable 9 may interfere with the contact arms 2 and 3. Also, if the lever 5 has been deformed plastically, when the flat cable 9 is inserted between the contact arms 2 and 3 again after being unclamped, and is clamped by operating the actuator 7, the contact arms 2 and 3 may not exert a sufficient clamping force on the flat cable 9.

SUMMARY

An object of the present invention is to provide an electrical connector capable of exerting a necessary and sufficient clamping force on a flat cable to reliably provide electrical conductivity while the connector is low-profile The electrical connector to electrically connect a flexible flat cable to a printed wiring board, includes a housing made of an insulating material and having a cavity into which an end portion of the flat cable is inserted, an actuator having a cam, and a contact. The contact accommodated in the housing, includes a base of the contact fixed to the housing and electrically connected to the printed wiring board, a lever extending from the base of the contact, a contact beam provided with a support arm that is supported by the lever, and a pressing arm projecting from the base toward the cam of the actuator. The cam of the actuator presses one end of the contact beam in a direction away from the printed wiring board while pressing the pressing arm and another end of the contact beam in a direction toward to the printed wiring board when a change-over operation of the contact to the clamping state is performed, the clamping state where the contact clamps end portion of the flat cable and thereby electrically connects to the printed wiring board.

BRIEF DESCRIPTION OF THE DRAWINGS

Embodiments of the invention are described in greater detail in the following description and are shown in a simplified manner in the drawings, in which.

DETAILED DESCRIPTION OF THE EMBODIMENT(S)

For an improved understanding of the invention, it will now be described in more detail with the aid of the drawings.

Figure 1A:
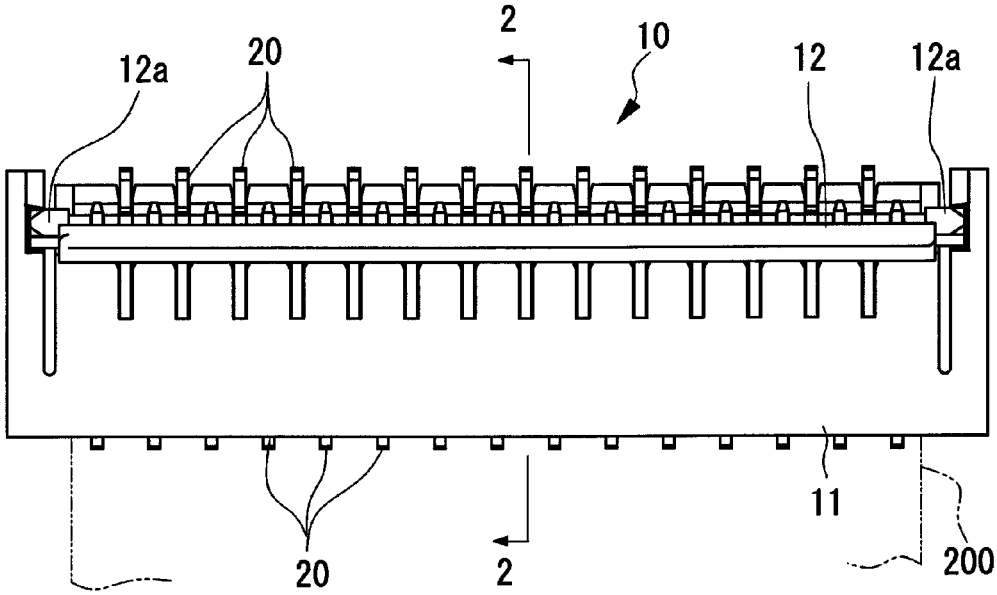
FIG. 1A is a plan view a connector according to the present invention.
Figure 1B:
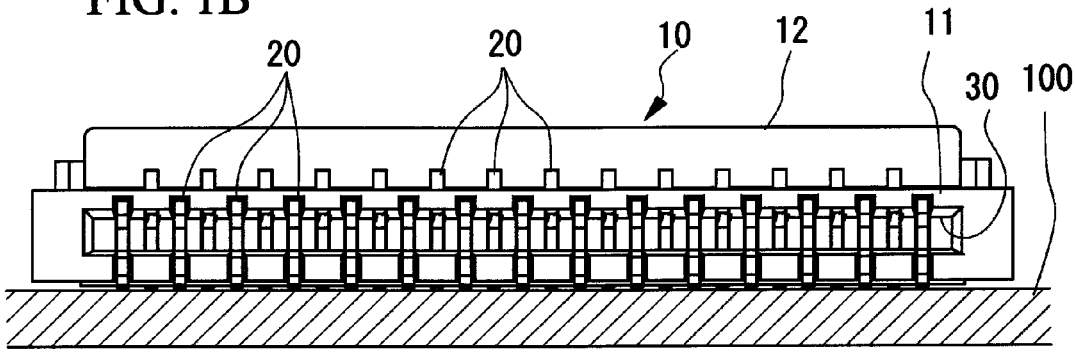
FIG. 1B is a front view of the connector of FIG. 1 according to the present invention.
Figure 1C:
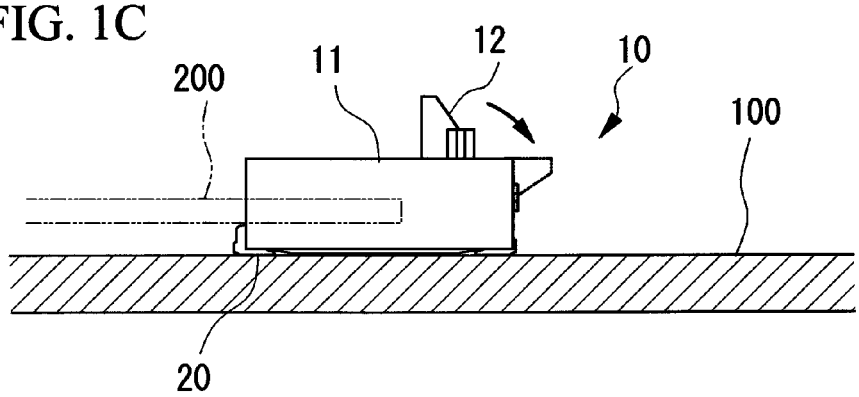
FIG. 1C is a side view of the connector of FIG. 1 according to the present invention.

As shown in FIGS. 1A to 1C, a connector (electrical connector) 10 is mounted on a printed wiring board 100 to electrically connect a flat cable 200 to the printed wiring board 100 by inserting an end portion of the flat cable 200. Hereinafter, for ease of explanation, in the connector 10, the side on which the connector 10 is mounted on the printed wiring board 100 (the lower side in FIG. 1C) is referred to as the lower side, and the side on which the flat cable 200 is inserted (the left side in FIG. 1C) is referred to as the front side.

As shown in FIGS. 1A to 1C, the connector 10 includes a housing 11, a plurality of contacts 20 accommodated in the housing 11, and an actuator 12 for operating these contacts 20.

In the embodiment shown, the housing 11 and the actuator 12 are each made of an insulating material, such as a resin. The contact 20 is formed by stamping a thin plate made of a conductive material such as a copper alloy.

On the front surface of the housing 11, a cavity 30 is formed so that the end portion of the flat cable 200 may be inserted into this cavity 30. The cavity 30 is open in a slit form.

In the cavity 30, the plurality of contacts 20 for making electrical connection with conductors in the end portion of the flat cable 200 are arranged in one row. The contacts 20 are arranged in the direction in which the slit-form cavity 30 is continuous (the longitudinal direction of the housing 11). The contacts 20 are press fitted into the housing 11.

The actuator 12 is made of an insulating material, such as a resin, like the housing 11, and is provided on the rear end side on the upper surface of the housing 11. The actuator 12 extends in the longitudinal direction (the width direction) of the housing 11, and pins 12*a* provided in both end portions thereof are pivotally mounted on the housing 11, so that the actuator 12 can rotate in a plane that is perpendicular to the surface of the printed wiring board 100 and includes the front-back direction of the housing 11.

Figure 2A:
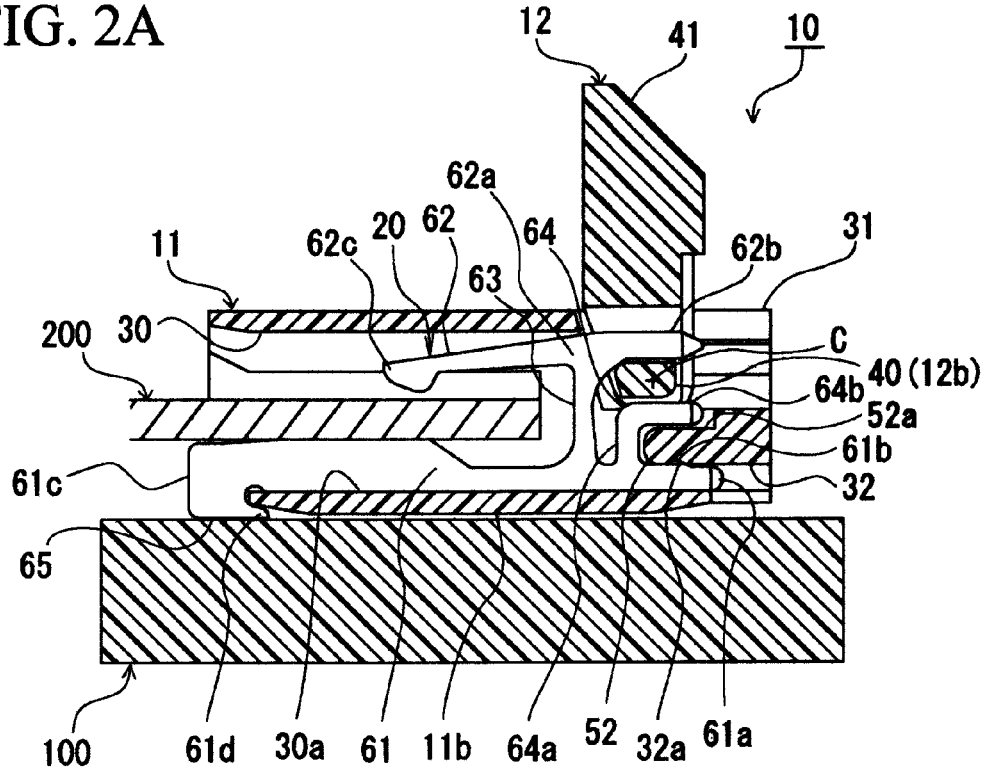
FIG. 2A is a cross-sectional view taken along the line 2-2 of FIG. 1A.
Figure 2B:
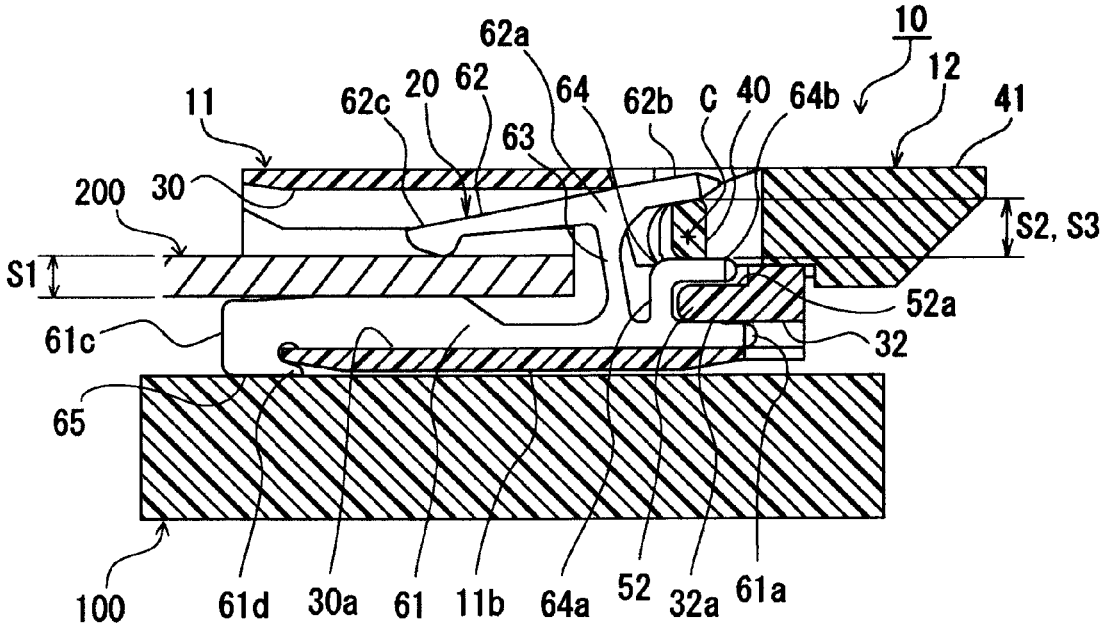
FIG. 2B is a cross-sectional view of the connector showing a state in which the deformation of a contact produced by an actuator is completed, and a flat cable is clamped.

As shown in FIGS. 2A and 2B, the actuator 12 has a camshaft 12*b* extending along the rotating shaft thereof, and the camshaft 12*b* is formed with cams 40 at positions corresponding to each of the contacts 20. The cam 40 is eccentrically provided with respect to the rotating center C (that is, the pin 12*a*) of the actuator 12. As shown in FIG. 2A, the cam 40 has a substantially rectangular cross section that is slightly long in the front-back direction in a state in which a lever 41 of the actuator 12 is erected with respect to the housing 11. In this state, the contacts 20 are opened so that when the flat cable 200 is inserted into the housing 11, the insertion resistance caused by friction against the flat cable 200 is restrained. As shown in FIG. 2B, when the actuator 12 is rotated, the cam 40 rotates to press the contact 20, whereby the actuator 12 can change over the contact 20 from the opened state to a clamping state in which the contact 20 clamps the flat cable 200.

As shown in FIGS. 2A and 2B, the cavity 30 is formed so as to be continuous to an intermediate portion in the front-back direction of the housing 11 so that the flat cable 200 is inserted into the cavity 30. The rear portion of the cavity 30 is opened upward to form a space 31 for accommodating the contacts 20 and the actuator 12. In the lower portion of the rear end portion of the cavity 30, a recess 32 that engages with the contacts 20 to fix them is formed. In the inner peripheral surface of the recess 32, an engaging recess 32*a* for engaging the contacts 20 is formed.

The contact 20 has a base 61 extending from the front of the housing 11 toward the rear thereof in a state in which the contact 20 is mounted in the housing 11, a contact beam 62 for being electrically connected to the flat cable 200, and a lever (deformed part) 63 formed between the base 61 and the contact beam 62. And the contact 20 is of a tuning fork type, such that the flat cable 200 is held and clamped between the contact beam 62 and the base 61.

A rear end section 61*a* of the base 61 is inserted into the recess 32 of the housing 11. The rear end section 61*a* is provided with a protrusion 61*b* corresponding to the engaging recess 32*a* formed in the recess 32. By the engagement of the protrusion 61*b* with the engaging recess 32*a*, the contact 20 is prevented from dropping off to the front.

In the bottom surface side of a front end section 61*c* of the base 61, a stopper claw 61*d* engaging with the front end portion on the bottom surface 11*b* side of the housing 11 is formed to restrict the rearward movement of the contact 20, in a state in which the rear end section 61*a* of the base 61 is inserted into the recess 32. The bottom surface of the front end section 61*c* in the base 61 that is located forward of the stopper claw 61*d*, serves as a tine 65, electrically connected to the conducive part of the printed wiring board 100. That is to say, in this embodiment, the stopper claw 61*d* and the tine 65 are continuously formed. Therefore, in a state in which the rear end section 61*a* of the base 61 is inserted into the recess 32, and the stopper claw 61*d* is engaged with the front end portion on the bottom surface 11*b* side of the housing 11, the tine 65 is approximately flush with the bottom surface 11*b* of the housing 11, or slightly projects downward from the bottom surface 11*b* of the housing 11.

The lever 63 is formed at a position closer to the rear end section 61*a* than a middle point between the rear end section 61*a* and the front end section 61*c* of the base 61, so as to extend upward from the base 61.

The contact beam 62 includes a support arm 62*a* supported by the lever 63, a lever arm 62*b* extending from the support arm 62*a* to the rear of the housing 11, and a contact arm 62*c* extending from the support arm 62*a* to the front of the housing 11 for being electrically connected to the flat cable 200.

The support arm 62*a* is a part in which the lever 63 joins with the contact beam 62.

The lever arm 62*b* is arranged above the cam 40 of the actuator 12. The lever arm 62*b* is shorter than the contact arm 62*c*, and is formed so as not to project rearward from the rear end section 61*a* of the base 61.

The contact arm 62*c* is formed so as to extend obliquely downward from the support arm 62*a*.

When the lever 41 of the actuator 12 is operated to rotate the actuator 12 in the clockwise direction, the cam 40 comes into contact with the lower surface of the lever arm 62*b* of the contact beam 62, and presses the lever arm 62*b* upward. At this time, the lever 63 is elastically deformed so as to fall down forward, because it has a cross-sectional area smaller than that of the contact beam 62, whereby the contact arm 62*c* of the contact beam 62 is displaced downward. When the contact arm 62*c*, being displaced downward, is pushed against the flat cable 200, after being inserted into the cavity 30, the contact arm 62*c* is electrically connected to the flat cable 200.

When the contact arm 62*c* is pushed against the flat cable 200 inserted into the cavity 30, the downward displacement of the contact arm 62*c* is restricted. When the actuator 12 is further rotated from this state, the contact beam 62 is elastically deformed. By a force such that this elastic deformation tends to be restored, the contact arm 62*c* of the contact beam 62 is pressed against the flat cable 200. Thereby, the flat cable 200 is clamped between the contact arm 62*c* of the contact beam 62 and the base 61. When the lever 41 of the actuator 12 is rotated to a state, being approximately parallel with the surface of the printed wiring board 100, the actuator 12 is locked by the cam 40.

The contact 20 further includes a pressing arm 64, which is subjected to a downward pressing force from the cam 40 of the actuator 12, under the cam 40 of the actuator 12. The pressing arm 64 is provided in the vicinity of the joint portion of the base 61 and the lever 63. The pressing arm 64 can have a substantially inverse L shape consisting of, for example, a columnar section 64*a* extending upward from a position at the rear of the joint portion of the base 61 and the lever 63, and a beam section 64*b* extending from the tip end of the columnar section 64*a* toward the rear.

The housing 11 includes a stopper 52, which restricts the downward displacement exceeding a fixed value of the beam section 64*b*, under the beam section 64*b* of the pressing arm 64. An upper surface 52*a* of the stopper 52 is formed so that a gap between the upper surface 52*a* and the beam section 64*b* has a predetermined dimension. When being pressed downward by the cam 40 of the actuator 12, the beam section 64*b* of the pressing arm 64 is elastically deformed downward. If the displacement caused by the elastic deformation exceeds a predetermined value, the beam section 64*b* of the pressing arm 64 comes into contact with the stopper 52, so that further displacement is restricted. In the state in which the beam section 64*b* of the pressing arm 64 comes into contact with the stopper 52, the pressing force of the cam 40 of the actuator 12 is distributed and applied to not only the beam section 64*b*, but also the stopper 52. Thereby, the force acting on the beam section 64*b* is reduced. In the case where the stopper 52 is not provided, the beam section 64*b* may be plastically deformed if the displacement of the beam section 64*b* becomes excessive. However, this plastic deformation can be prevented by providing the stopper 52.

At the same time that the cam 40 of the actuator 12 presses the lever arm 62*b* of the contact beam 62 upward, as described above, some of the pressing force generated by the cam 40 is transmitted to the pressing arm 64, and presses the beam section 64*b* of the pressing arm 64 downward. When the lever arm 62*b* of the contact beam 62 is pressed upward, the lever 63 is elastically deformed as described above. At this time, on the base 61, a force such as to raise the base 61 upward acts in the joint portion of the base 61 and the lever 63. On the other hand, the base 61 of the contact 20 is pressed downward by the cam 40 of the actuator 12 through the pressing arm 64, so that the base 61 is prevented from lifting. As a result, the displacement of the contact 20 becomes the displacement to be produced inherently by the operation amount of the actuator 12, so that the flat cable 200 can be pressed reliably. Moreover, by pressing the base 61 through the pressing arm 64, the base 61 can be prevented from lifting without lengthening the contact beam 62, and the connector 10 is not hindered from being low-profile.

At this time, the deformation state of the beam section 64*b* of the pressing arm 64 differs depending on the thickness S1 of the flat cable 200, the gap S2 between the lever arm 62*b* of the contact beam 62 and the beam section 64*b* of the pressing arm 64 in the contact 20, and the dimension S3 in the major axis direction of the cam 40 of the actuator 12.

Figure 3A:
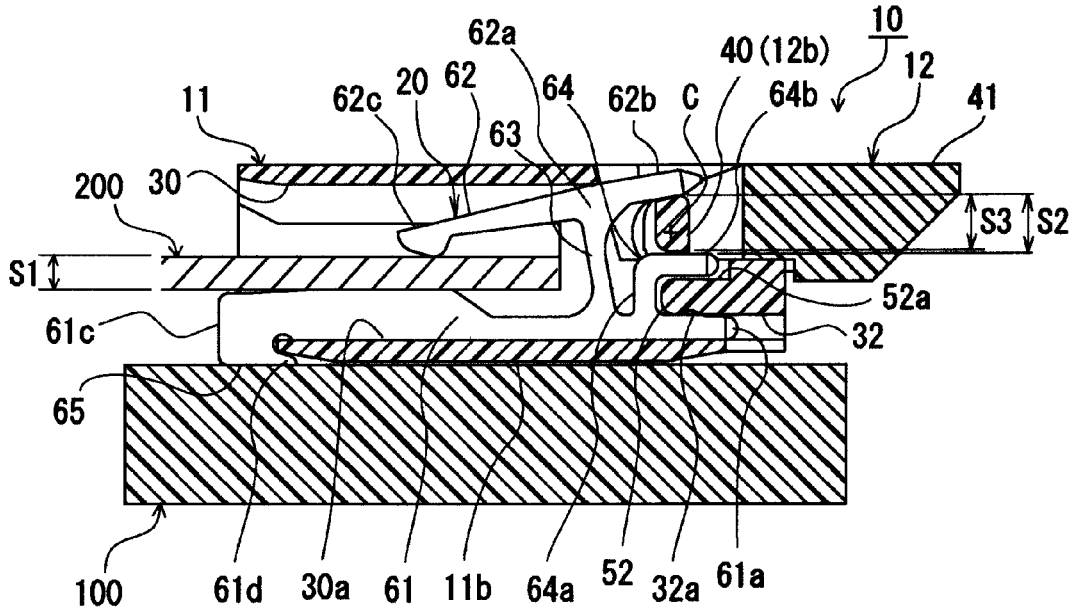
FIG. 3A is a cross-sectional of the connector view showing a case where a part to be pressed is deformed less than in the case shown in FIG. 2B.

As shown in FIG. 3A, in the case where the thickness S1 is smaller, the gap S2 is wider, or the dimension S3 is smaller than those in the case shown in FIG. 2B, the cam 40 of the actuator 12 may not come into contact with the beam section 64*b* of the pressing arm 64. In such a case, the displacement of the beam section 64*b* is also not produced. In this case, all of the pressing force generated by the cam 40 can be transmitted to the lever arm 62*b* of the contact beam 62, so that the flat cable 200 can be clamped reliably.

Figure 3B:
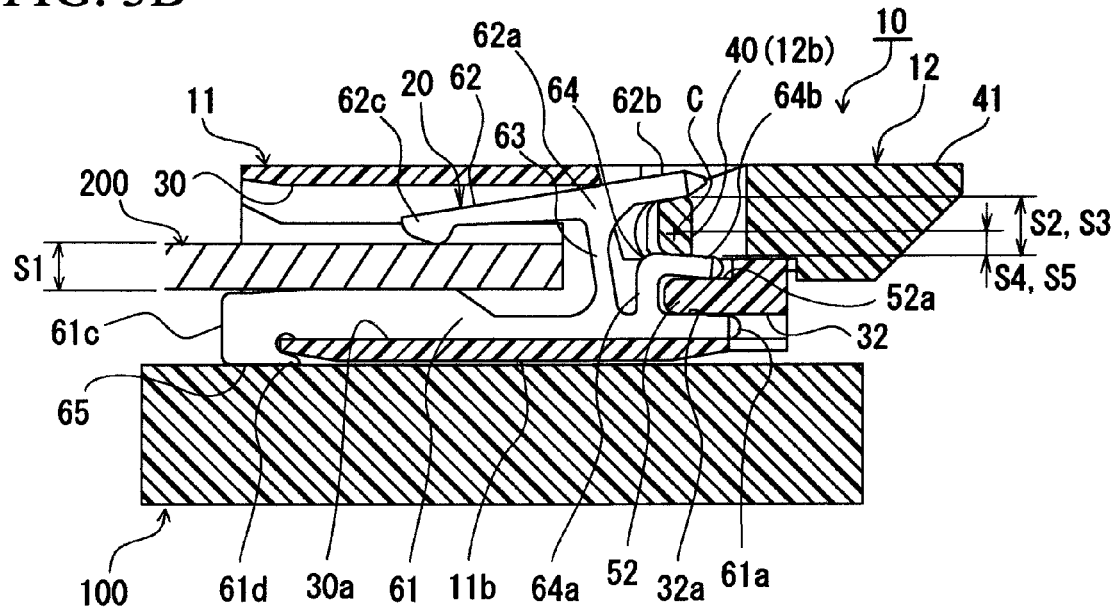
FIG. 3B is a cross-sectional view of the connector showing a case where the part to be pressed is deformed more than in the case shown in FIG. 2B.

When the contact arm 62*c* is pushed against the flat cable 200 by operating the contact beam 62 using the actuator 12, the cam 40 is pressed downward by the reaction force from the contact beam 62. As shown in FIG. 3B, in the case where the thickness S1 is larger, the gap S2 is narrower, or the dimension S3 is larger than those in the case where each part is as designed as shown in FIG. 2B, when the cam 40 is pressed by the contact beam 62, the camshaft 12*b* itself of the actuator 12 is elastically deformed in the direction perpendicular to the camshaft 12*b*, so that the cam 40 is displaced. Thereby, the displacement of the lever arm 62*b* produced by the cam 40 is reduced, and therefore the contact pressure applied to the flat cable 200 in the contact arm 62*c* of the contact beam 62 can be reduced. In this case, if the beam section 64*b* is displaced until coming into contact with the stopper 52, the force applied to the beam section 64*b* can also be distributed to the housing 11.

Also, in the case where the dimension S4 on the pressing arm 64 side from the rotation center of the cam 40 or the gap S5 between the rotation center of the cam 40 and the beam section 64*b* of the pressing arm 64 is smaller than those in the case where each part is as designed as shown in FIG. 2B, the pressing force generated by the cam 40 of the actuator 12 tends to become excessive. In these cases, the beam section 64*b* of the pressing arm 64 is deformed downward by the pressing force generated by the cam 40 of the actuator 12, whereby the pressing force transmitted to the lever arm 62*b* of the contact beam 62 can be reduced, and the contact pressure in the contact arm 62*c* can be lowered. In this case as well, if the beam section 64*b* is displaced until coming into contact with the stopper 52, the force applied to the beam section 64*b* can also be distributed to the housing 11.

Thus, by providing the pressing arm 64 in the contact 20, the pressing force of the cam 40 of the actuator 12 can be transmitted to the base 61 through the pressing arm 64. As a result, the deformation of the base 61, such that the base 61 lifts up from a bottom surface 30*a* of the cavity 30, can be restrained. Therefore, the flat cable 200 is clamped reliably by the contact 20, and the electrical conduction between the contact 20 and the flat cable 200 can be achieved reliably.

Also, by the elastic deformation of the pressing arm 64, the range of variations in the contact pressure of the contact arm 62*c* of the contact beam 62 caused by the variations in the thickness S1, the gap S2, the dimension S3, and the like can be made narrow. That is to say, the variations in the thickness S1, the gap S2, the dimension S3, and the like are permitted. In particular, even in the case where the thickness S1 of the flat cable 200 is excessive, the contact pressure of the contact arm 62*c* can be effectively prevented from becoming excessive. Therefore, the plastic deformation of the contact 20 that may be produced as the result of excessive contact pressure can be prevented. Accordingly, the durability of the contact 20 can be enhanced, while the contact 20 clamps the flat cable 200 reliably.

Moreover, the contact 20 is of a tuning fork type shape, such that the connector 10 can be low-profile. The length of the lever arm 62*b* is set so as to be shorter than the contact arm 62*c* and such that the lever arm 62*b* does not project rearward from the rear end section 61*a* of the base 61. Since the contact 20 can clamp the flat cable 200 reliably without lengthening the lever arm 62*b*, the displacement of the lever arm 62*b* at the time when the lever arm 62*b* is operated by the actuator 12 is also small, so that the connector 10 is not hindered from being low-profile. Also, it is unnecessary to increase the rigidity of the lever arm 62*b* to prevent the lift of the base 61, and the operability of the actuator 12 is not degraded as the result of the increase in force necessary for the operation of the actuator 12.

In the above-described embodiment, an example of the specific shape of the pressing arm 64 has been described. However, there is no intention of denying the adoption of other shapes. By the elastic deformation of the part to be pressed, variations in manufacture dimensions of the housing, contact, and cam can be allowed.

For example, if the purpose is only to prevent the lift of the base 61, the pressing arm 64 can be made a block-shaped convex part that is not elastically deformed by the operation of the actuator 12.

Figure 4:
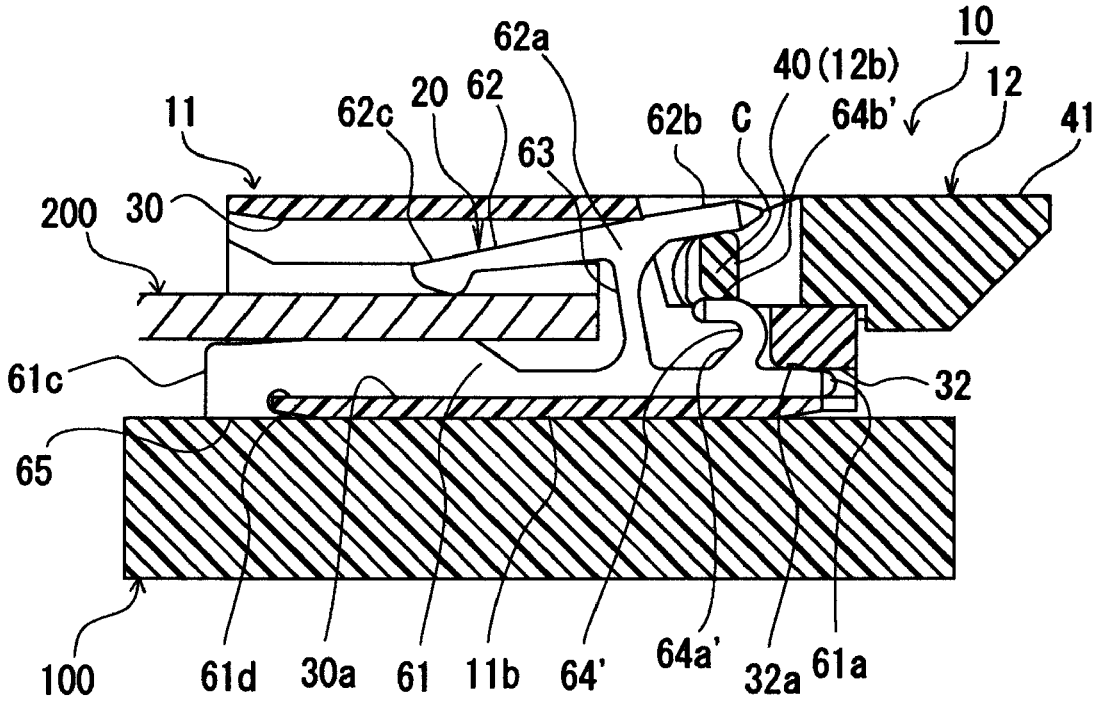
FIG. 4 is a cross-sectional view of the connector showing another example of the shape of a part to be pressed.
Figure 5:
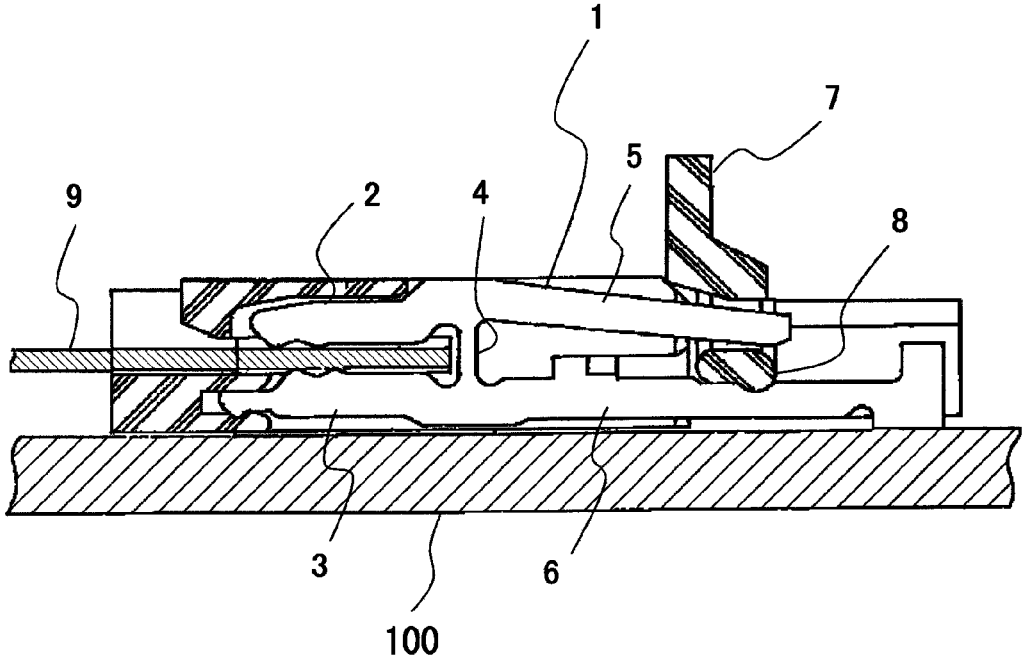
FIG. 5 is a cross-sectional view of a known conventional electrical connector.

Also, as shown in FIG. 4, a beam section 64*b*' may be formed into a shape extending toward the front of the housing 11 with respect to a columnar section 64*a*' of a pressing arm 64'. Further, the columnar section 64*a*' of the pressing arm 64' may have a shape extending obliquely rearward from the base 61. With the pressing arm 64' having such a shape, the moment produced by the pressing force of the cam 40, as applied to the base 61 through the pressing arm 64', acts in the direction such that the joint portion of the base 61 and the lever 63 is pushed downward. Therefore, it can be anticipated that the lift of the base 61 will be effectively restrained.

Although the actuator 12 is of a so-called back flip type in the embodiment shown, such that the actuator 12 rotates on the rear side with respect to the insertion direction of the flat cable 200, the actuator 12 can also be of a front flip type, such that the actuator 12 rotates on the front side with respect to the insertion direction of the flat cable 200. Also, the position of the actuator 12 is not limited to the rear end side of the housing 11, and the actuator 12 may be provided on the front end side or the like of the housing 11.

Also, the detailed configurations of the housing 11, the contact 20, and the like can be changed appropriately without departing from the spirit and scope of the present invention.

Besides these, the configurations described in the above-described embodiment can be selected optionally or can be changed appropriately to other configurations without departing from the spirit and scope of the present invention.

The invention claimed is:

1. An electrical connector comprising:

an insulative housing having a cavity into which an end portion of a flat cable is insertable;

an actuator having a cam;

a contact in the housing;

a base of the contact fixed to the housing and electrically connectable to a printed wiring board;

a lever extending from the base of the contact;

a contact beam having a support arm supported by the lever; and a pressing arm projecting from the base toward the cam;

wherein the cam, when actuated urges one end of the contact beam away from the printed wiring board while urging the pressing arm and another end of the contact beam toward the printed wiring board electrically connecting it to the flat cable.

2. The electrical connector according to claim 1, wherein the contact beam further comprises:

a lever arm extending from the support arm to one side of the housing; and a contact arm extending from the support arm to another side of the housing and being electrically connected to the flat cable upon actuation of the cam.

3. The electrical connector according to claim 2, wherein the cam is arranged between the lever arm and the pressing arm.

4. The electrical connector according to claim 2, wherein the contact arm is longer than the lever arm.

5. The electrical connector according to claim 1, wherein the pressing arm is elastically deformable.

6. The electrical connector according to claim 5, wherein the housing further comprises a stopper for restricting the elastic deformation.

7. The electrical connector according to claim 1, wherein the pressing arm further comprises:

a columnar section extending from the base toward the cam; and a beam section formed continuously with the columnar section and extending toward one end side of the housing.

8. The electrical connector according to claim 1, wherein the contact has a tuning fork shape such that the flat cable is held and clamped between the contact beam and the base.

9. The electrical connector according to claim 1, wherein the base further comprises:

a claw at an end portion on one end side of the base, the claw engaging with an end portion on one end side of the housing; and a tine electrically connected to a conducive part of the printed wiring board, the tine formed continuously with the claw.

10. The electrical connector according to claim 1, wherein the lever is located closer to one side of the base than a middle point of the base.

11. The electrical connector according to claim 1, wherein the pressing arm is located in the vicinity of a joint portion of the base and the lever.

* * * * *